US006123664A

United States Patent [19]

Ard

[11] Patent Number: 6,123,664

[45] Date of Patent: Sep. 26, 2000

[54] EXERCISE DEVICE FOR MEN

[76] Inventor: William P. Ard, 3080 Skywood St., Orange, Calif. 92865

[21] Appl. No.: 09/282,251

[22] Filed: Mar. 31, 1999

[51] Int. Cl.[7] ..... A61F 5/00

[52] U.S. Cl. ..... 600/38; 482/124; 482/91; 600/39

[58] Field of Search ..... 600/38, 39, 40, 600/41; 482/124, 91

[56] References Cited

U.S. PATENT DOCUMENTS

| | | | |
|---|---|---|---|
| 4,381,000 | 4/1983 | Duncan | 600/39 |
| 4,440,183 | 4/1984 | Miller | 600/40 |
| 4,488,541 | 12/1984 | Garcia | 600/40 |
| 4,660,551 | 4/1987 | Nishimura | 600/40 |
| 4,724,829 | 2/1988 | Knapps | 600/40 |
| 5,103,810 | 4/1992 | Chang | 600/39 |
| 5,244,454 | 9/1993 | Coats | 600/38 |
| 5,728,043 | 3/1998 | Yong | 600/39 |
| 5,893,827 | 4/1999 | Jaquez et al. | 600/38 |

*Primary Examiner*—Jerome Donnelly
*Attorney, Agent, or Firm*—Goldstein & Canino

[57] ABSTRACT

An exercise device for men including a belt portion adapted for coupling around a waist of a male user. A strap portion is adjustably secured to a rear portion of the belt portion. A buckle is secured to an outer surface of the strap portion. The buckle has a pair of laces extending outwardly of a lower end thereof. A forward ring is secured to a forward portion of the belt portion. The forward ring is dimensioned for receiving a penis of the male user therein. The forward ring is secured to free ends of the pair of laces whereby the laces extend under an underside of the male user and are disposed on opposing sides of a scrotum of the male user.

6 Claims, 1 Drawing Sheet

EXERCISE DEVICE FOR MEN

BACKGROUND OF THE INVENTION

The present invention relates to an exercise device for men and more particularly pertains to exercising the sphincter muscles, anal and pineal, through isometrics.

Colon and prostate cancer is an increasing concern for aging males in society today. Men think that there is very little they can do, other than eat properly, to ensure that they will not fall victim to these fatal diseases. The present invention seeks to provide an invention that will exercise the muscles associated with these diseases in an effort to reduce the likelihood that men would be stricken with these diseases. The use of the present invention will strengthen these muscles by tightening and releasing thereby stopping the urges of the flow of urine and feces. Additionally, the present invention will also increase the sex drive in men.

The use of isometric exercise devices is known in the prior art. More specifically, isometric exercise devices heretofore devised and utilized for the purpose of exercising various parts of the body are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,445,582 to Brown discloses a rigid circular band attachable to the wrist and used to strengthen the fingers. U.S. Pat. No. 5,069,449 to Wardwell discloses an exercise device consisting of an elongated strap used to assist in chest movements and improve a user's breathing.

While these devices fulfill their respective, particular objective and requirements, the aforementioned patents do not describe an exercise device for men for exercising the sphincter muscles, anal and pineal, through isometrics.

In this respect, the exercise device for men according to the present invention substantially departs from the conventional concepts and designs of the prior art, and in doing so provides an apparatus primarily developed for the purpose of exercising the sphincter muscles, anal and pineal, through isometrics.

Therefore, it can be appreciated that there exists a continuing need for new and improved exercise device for men which can be used for exercising the sphincter muscles, anal and pineal, through isometrics. In this regard, the present invention substantially fulfills this need.

SUMMARY OF THE INVENTION

In the view of the foregoing disadvantages inherent in the known types of isometric exercise devices now present in the prior art, the present invention provides an improved exercise device for men. As such, the general purpose of the present invention, which will be described subsequently in greater detail, is to provide a new and improved exercise device for men and method which has all the advantages of the prior art and none of the disadvantages.

To attain this, the present invention essentially comprises a belt portion adapted for coupling around a waist of a male user. A strap portion is adjustably secured to a rear portion of the belt portion. The strap portion has a pair of buckles disposed on opposing ends thereof for adjustably coupling with the belt portion. The strap portion is comprised of a pair of non-stretchable outer portions and an elastomeric center portion. A buckle is secured to an outer surface of the elastomeric center portion of the strap portion. The buckle has a pair of laces extending outwardly of a lower end thereof. A forward ring is secured to a forward portion of the belt portion. The forward ring is dimensioned for receiving a penis of the male user therein. The forward ring includes a support strap disposed therein for supporting the penis. The forward ring is secured to free ends of the pair of laces whereby the laces extend under an underside of the male user and are disposed on opposing sides of a scrotum of the male user. The forward ring has a satin cover disposed therearound.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved exercise device for men which has all the advantages of the prior art isometric exercise devices and none of the disadvantages.

It is another object of the present invention to provide a new and improved exercise device for men which may be easily and efficiently manufactured and marketed.

It is a further object of the present invention to provide a new and improved exercise device for men which is of durable and reliable construction.

An even further object of the present invention is to provide a new and improved exercise device for men which is susceptible of a low cost of manufacture with regard to both materials and labor, and which accordingly is then susceptible of low prices of sale to the consuming public, thereby making such an exercise device for men economically available to the buying public.

Even still another object of the present invention is to provide a new and improved exercise device for men for exercising the sphincter muscles, anal and pineal, through isometrics.

Lastly, it is an object of the present invention to provide a new and improved exercise device for men including a belt portion adapted for coupling around a waist of a male user. A strap portion is adjustably secured to a rear portion of the belt portion. A buckle is secured to an outer surface of the strap portion. The buckle has a pair of laces extending outwardly of a lower end thereof. A forward ring is secured to a forward portion of the belt portion. The forward ring is dimensioned for receiving a penis of the male user therein. The forward ring is secured to free ends of the pair of laces whereby the laces extend under an underside of the male user and are disposed on opposing sides of a scrotum of the male user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
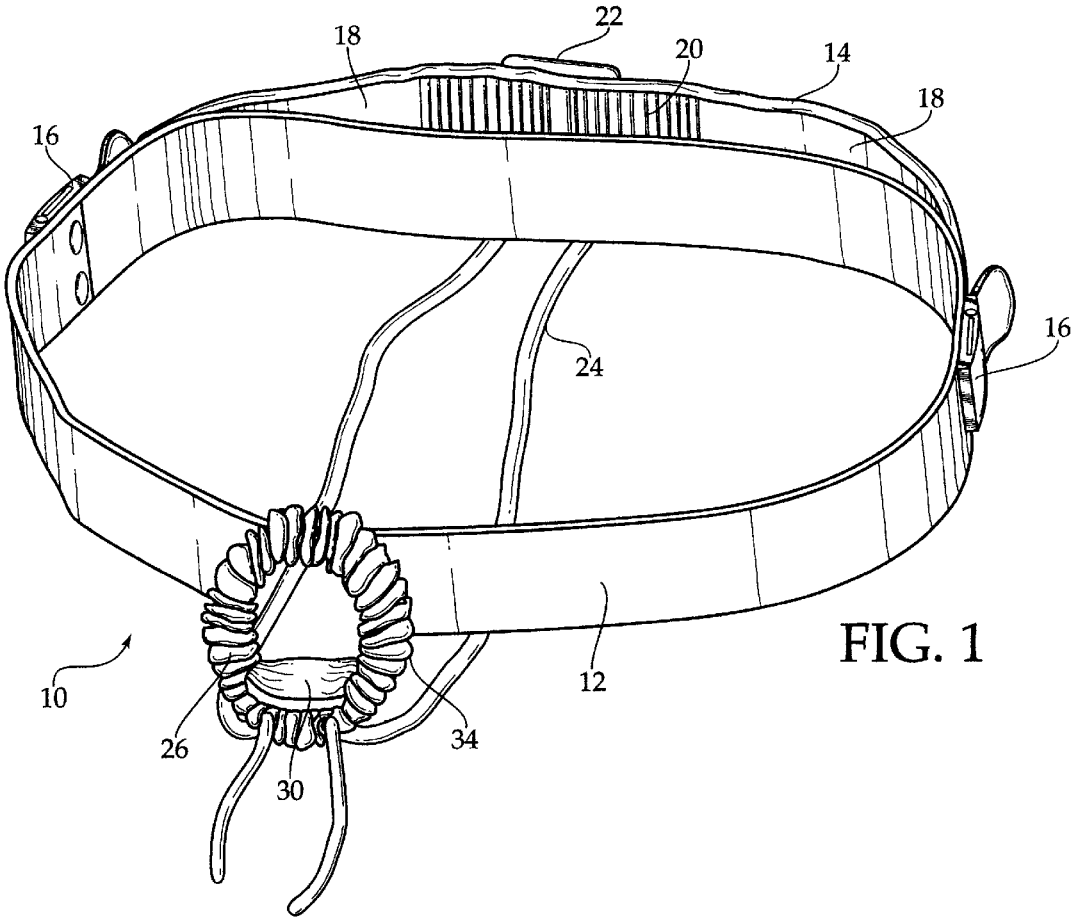
FIG. 1 is a perspective view of the preferred embodiment of the exercise device for men constructed in accordance with the principles of the present invention.
Figure 2:
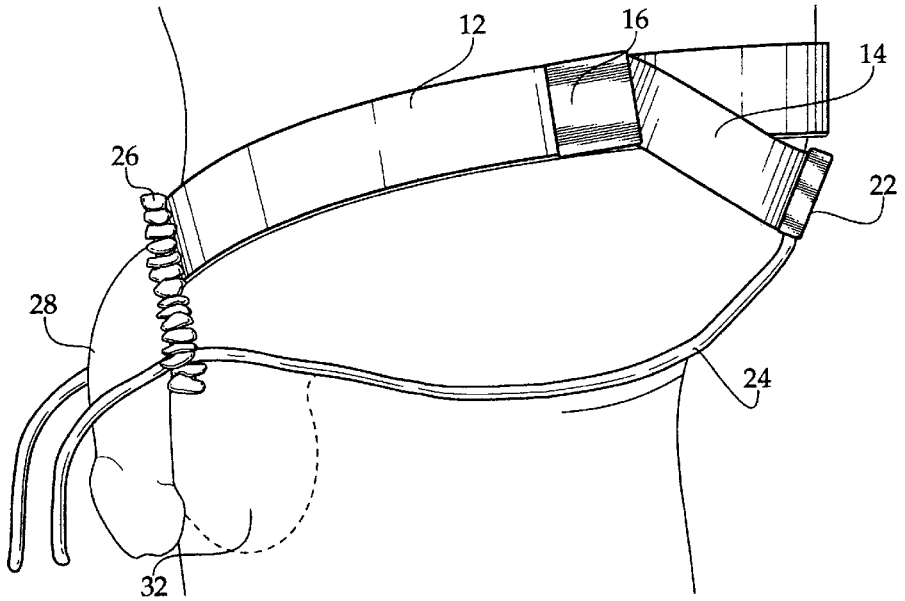
FIG. 2 is a side view of the present invention illustrated in use.

With reference now to the drawings, and in particular, to FIGS. 1 through 2 thereof, the preferred embodiment of the new and improved exercise device for men embodying the principles and concepts of the present invention and generally designated by the reference number 10 will be described.

Specifically, it will be noted in the various Figures that the device relates to a exercise device for men for exercising the sphincter muscles, anal and pineal, through isometrics. In its broadest context, the device consists of a belt portion, a strap portion, a buckle, and a forward ring. Such components are individually configured and correlated with respect to each other so as to attain the desired objective.

The belt portion 12 is adapted for coupling around a waist of a male user. Note FIG. 2.

The strap portion 14 is adjustably secured to a rear portion of the belt portion 12. The strap portion 14 has a pair of buckles 16 disposed on opposing ends thereof for adjustably coupling with the belt portion 12. The strap portion 14 is comprised of a pair of non-stretchable outer portions 18 and an elastomeric center portion 20. The elastomeric center portion 20 enables the strap portion 14 to stretch in order to exercise the sphincter muscles of the male user.

The buckle 22 is secured to an outer surface of the elastomeric center portion 20 of the strap portion 14. The buckle 22 has a pair of laces 24 extending outwardly of a lower end thereof.

The forward ring 26 is secured to a forward portion of the belt portion 12. The forward ring 26 is dimensioned for receiving a penis 28 of the male user therein. The forward ring 26 includes a support strap 30 disposed therein for supporting the penis 28. The forward ring 26 is secured to free ends of the pair of laces 24 whereby the laces 24 extend under an underside of the male user and are disposed on opposing sides of a scrotum 32 of the male user. The forward ring 26 has a satin cover 34 disposed therearound.

In use, the belt portion 12 is slipped onto the waist of the male user. The strap portion 14 is adjusted so that it rests on the buttock region. Note FIG. 2. The laces 24 are positioned under the perineum of the male user and disposed on opposing sides of the scrotum 32 with the forward ring 26 receiving the penis 28 therethrough. In this orientation, the laces 24 will apply upward pressure on the sphincter muscles to fulfill the objectives of the present invention, namely preventing prostate and colon cancer.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. An exercise device for men for exercising the sphincter muscles, anal and pineal, through isometrics comprising, in combination:

a belt portion adapted for coupling around a waist of a male user;

a strap portion adjustably secured to a rear portion of the belt portion, the strap portion having a pair of buckles disposed on opposing ends thereof for adjustably coupling with the belt portion, the strap portion being comprised of a pair of non-stretchable outer portions and an elastomeric center portion;

a buckle secured to an outer surface of the elastomeric center portion of the strap portion, the buckle having a pair of laces extending outwardly of a lower end thereof;

a forward ring secured to a forward portion of the belt portion, the forward ring being dimensioned for receiving a penis of the male user therein, the forward ring including a support strap disposed therein for supporting the penis, the forward ring being secured to free ends of the pair of laces whereby the laces extend under an underside of the male user and are disposed on opposing sides of a scrotum of the male user, the forward ring having a satin cover disposed therearound.

2. An exercise device for men for exercising the sphincter muscles, anal and pineal, through isometrics comprising, in combination:

a belt portion adapted for coupling around a waist of a male user;

a strap portion adjustably secured to a rear portion of the belt portion;

a buckle secured to an outer surface of the strap portion, the buckle having a pair of laces extending outwardly of a lower end thereof;

a forward ring secured to a forward portion of the belt portion, the forward ring being dimensioned for receiving a penis of the male user therein, the forward ring being secured to free ends of the pair of laces whereby the laces extend under an underside of the male user and are disposed on opposing sides of a scrotum of the male user.

3. The exercise device for men as set forth in claim 2 wherein the strap portion has a pair of buckles disposed on opposing ends thereof for adjustably coupling with the belt portion.

4. The exercise device for men as set forth in claim 2 wherein the strap portion is comprised of a pair of non-stretchable outer portions and an elastomeric center portion.

5. The exercise device for men as set forth in claim 2 wherein the forward ring includes a support strap disposed therein for supporting the penis.

6. The exercise device for men as set forth in claim 2 wherein the forward ring has a satin cover disposed therearound.

* * * * *